US005505068A

United States Patent [19]

Bartels

[11] Patent Number: 5,505,068

[45] Date of Patent: Apr. 9, 1996

[54] METHOD AND APPARATUS FOR SHAPING HOLLOW-SECTION WORKPIECES

[76] Inventor: Hermann Bartels, D-63165 Muhlheim, Louis-Raverat-Str. 23, Germany

[21] Appl. No.: 217,924

[22] Filed: Mar. 25, 1994

[30] Foreign Application Priority Data

Mar. 26, 1993 [DE] Germany ..... 43 09 932.7

[51] Int. Cl.[6] ..... B21D 22/00

[52] U.S. Cl. ..... 72/62; 72/58

[58] Field of Search ..... 72/57, 58, 61, 72/62

[56] References Cited

U.S. PATENT DOCUMENTS

| | | | |
|---|---|---|---|
| 249,193 | 11/1881 | Mallory | 72/62 |
| 2,357,447 | 9/1944 | Benson | 72/58 |
| 4,667,497 | 5/1987 | Oslin et al. | 72/61 |

FOREIGN PATENT DOCUMENTS

| | | | |
|---|---|---|---|
| 44431 | 3/1982 | Japan | 72/58 |
| 5430 | 9/1894 | Sweden | 72/62 |
| 590039 | 1/1978 | U.S.S.R. | 72/58 |

*Primary Examiner*—David Jones

*Attorney, Agent, or Firm*—Gifford, Krass, Groh, Sprinkle, Patmore, Anderson & Citkowski

[57] ABSTRACT

In a method and apparatus for shaping hollow-section workpieces such as tubes of metal, the workpiece is introduced into a pressing mold whose internal contour corresponds to the workpiece shape to be produced. After closure of the pressing mold a pressure medium in the form of solid matter particles or elements such as steel balls is pressed by means of a bar into the workpiece, applying it against the internal contour of the pressure mold. In that operation an upsetting movement of the workpiece is superimposed on the bar movement. The bar can be pressed into the workpiece in two or more steps, in which case the pressure medium is further advanced by means of a pressure cylinder between the respective steps after a respective withdrawal movement of the bar.

29 Claims, 5 Drawing Sheets

METHOD AND APPARATUS FOR SHAPING HOLLOW-SECTION WORKPIECES

BACKGROUND OF THE INVENTION

One form of operating procedure for shaping hollow-section workpieces involves introducing the workpieces to be shaped into a pressing mold having an internal contour which corresponds to the workpiece shape to be produced. Oil or a water-oil emulsion is then pressed into the workpiece, under high pressure, by a pressure-generating system such as a pressure cylinder unit. When a sufficiently high pressure is applied within the workpiece, the desired workpiece shaping effect is then achieved by virtue of the outside surface of the workpiece being caused to bear against the internal contour of the pressing mold. However, the use of liquid or gaseous pressure agents in that operation gives rise to sealing problems because the hollow-section workpieces, for example of aluminium, suffer from tolerances so that continuous adaptation of the sealing region, in relation to the pressing mold, is required. It is scarcely a viable proposition to use flexible seals at very high pressures, particularly when more elevated temperatures are involved. There is also the consideration that the open involvement with oil also gives rise to high levels of expenditure in regard to environmental aspects and regulations relating thereto.

It is also already known from 'Industries-Anzeiger, Essen' No 37, May 8th 1951, pages 393 through 396, and DD patent specification No 25 188, to use solid matter particles or elements such as sand or small balls, as a pressure medium for producing a pressure within a hollow-section workpiece to effect shaping thereof. In those procedures however the degrees of shaping deformation of the workpieces that can be achieved and the quality of shaping are generally insufficient, in particular because when the high pressures required are used the solid particles tend to jam together and then the fact that the solid particles can no longer move to a sufficient extent means that no further shaping of the workpiece can be achieved.

SUMMARY OF THE INVENTION

An object of the present invention is to provide a method of shaping hollow-section workpieces of metal which can produce shaping results quickly and at low cost.

Another object of the present invention is to provide a method of shaping hollow-section workpieces of metal which can be operated rapidly and without involving functional complications.

Still a further object of the present invention is to provide a method of shaping hollow-shaping workpieces of metal which permits specific control of the shaping effect while involving a simple operating procedure.

Yet another object of the present invention is to provide an apparatus for shaping hollow-section workpieces which is of a simple construction and which is rapid in operation while permitting high degrees of workpiece shaping.

In accordance with the present invention the foregoing and other objects are attained by a method of shaping hollow-section workpieces of metal, wherein the workpiece to be shaped is introduced into a pressing mold having an internal contour corresponding to the workpiece shape to be produced. When the pressing mold is closed, a pressure medium comprising solid matter means such as solid particles or elements, for example steel balls, is pressed into the workpiece in such a way that the workpiece is shaped by being applied against the internal contour of the pressing mold. A bar means is pressed into the pressure medium for the purposes of generating pressure therein.

In accordance with a preferred feature of the invention an upsetting movement of the workpiece may be superimposed on the movement of the bar means. Such simultaneous upsetting movement of the workpiece which is superimposed on the movement of the bar means can at least contribute to reducing the reductions in thickness of the wall of the workpiece which can otherwise occur when using high degrees of deformation of a workpiece for the purposes of shaping thereof, and the resulting reductions in workpiece wall strength, to such an extent that the workpiece may even tear. The upsetting movement can advantageously be effected in parallel relationship with the movement of the bar means, that is to say in the same direction as or the opposite direction to the movement of the bar means.

In another preferred feature of the invention the operation of pressing the bar means into the pressure medium in the workpiece is effected in two or more steps and the pressure medium is advanced between the respective steps after a respective withdrawal or retraction movement of the bar means. In that operation, the advance movement of the pressure medium can be produced by means of a pressure cylinder but, if the arrangement is disposed vertically, the pressure medium advance movement can also take place under the influence of the force of gravity.

In an advantageous feature the movement of the bar means and the upsetting movement of the workpiece can be controlled independently of each other. That can provide a workpiece is successively expanded in a plurality of regions by one or more steps in the movement of the bar means, with different upsetting movements of the workpiece, for example in such a way that in some regions the wall thickness of the workpiece is maintained as the workpiece is expanded within the pressing mold, whereas in other regions of the workpiece the wall thickness thereof is reduced. The control action can take place in accordance with a preselected program.

Another preferred feature of the invention can provide that the pressure medium can be shaken or jolted after and/or during the withdrawal or retraction movement of the bar member as well as during the advance movement of the pressure medium. When that is done, any jamming of the solid matter particles or like elements, and more specifically even smooth steel balls, can be reliably broken up so that further shaping deformation of the workpiece is possible in the next operating step.

In another preferred feature of the invention the workpiece is heated to a temperature of at least 200° C. It will be noted at this point that the degrees of workpiece shaping which can be achieved in one step with the above-mentioned prior methods using for example a water-oil emulsion are restricted, in spite of the use of very high pressures. While it may be known that the shapeability of the respective material of which the workpiece is made can be considerably increased at elevated temperatures and in particular above the recrystallization threshold, the above-mentioned prior method which uses a water-oil emulsion cannot be employed as the recrystallization threshold for example for aluminium is between 330° and 550° C. Such a water-oil emulsion can only be used at temperatures of up to 100° C. Oil when used as a pressure medium requires a closed transportation and operating system, when carrying out operation at temperatures over 200° C., in order to prevent oxidation of the oil and to comply with the provisions and requirements relating to safety. It is however readily possible to select solid matter particles or the like elements which are capable of withstanding even very high temperatures so that better and easier shaping of a workpiece can then be achieved in the desired manner. At temperatures above 200° C., in the case of most metals but in particular also in the case of aluminum, tensile strength and hardness have fallen in comparison with the values obtaining at ambient temperature, to such a degree that the pressures required in carrying the method of the invention into effect can be substantially lower. At the same time elongation at fracture and reduction in area at fracture generally increase so that greater degrees of shaping deformation of the workpiece are possible.

Preferably the pressure medium may comprise metal balls with a radius of r<5 mm, preferably <2 mm. Alternatively it is also possible to use silicon oxide grains or balls which are then desirably larger than 0.3 mm and which are preferably between 0.5 and 1.0 mm in size. It is also possible for two or more kinds and/or sizes of solid matter particles to be mixed.

In a preferred operating procedure heating of the workpiece can be effected at least in part by heating the pressing mold to the required temperature. Alternatively or in addition the workpiece can be preheated before being introduced into the pressing mold. In the same way it is also possible for the pressure medium to be preheated before being pressed into the mold.

In accordance with another aspect of the invention the foregoing and other objects are achieved by an apparatus for shaping hollow-section workpieces of metal comprising a pressing mold having an internal contour corresponding to the shape of a workpiece to be produced. The apparatus includes a pressing means with which, after closure of the pressing mold, a pressure medium comprising solid matter particles or elements such as steel balls is pressed into the pressing mold whereby the workpiece is shaped by being applied against the internal contour of the pressing mold. The pressing means further has a bar means which can be pressed into the pressing medium for generating pressure therein.

A preferred embodiment of the apparatus according to the invention provides that the bar is in the shape of a cone. In this connection it will be noted that the term cone means not just a cone of circular configuration but a cone of any cross-section, for example square, rectangular or elliptical. The cone may be a straight or curved cone. The tip of the cone may also be rounded off or it may terminate in a surface or a cutting edge-like configuration.

The apparatus for shaping tubular workpieces may also include a guide tube which bears against the inside wall surface of the tubular workpiece and which has an internal axial bore for slidingly accommodating the bar means, together with a means for axial displacement of the guide tube in the workpiece. By virtue of that arrangement, the workpiece can be shaped by being caused to bear against the internal contour of the pressing mold, in two or more axially successively disposed regions thereof, in succession, with the pressing mold being of a suitable internal configuration for that purpose. In operation the guide tube is firstly axially displaced to the beginning of the first region in which deformation of the workpiece for shaping thereof is to occur. The tubular workpiece is then shaped in that region. It is only after axial withdrawal of the guide tube to the beginning of the second region in which the workpiece is to be deformed for shaping thereof that the pressure medium can also take effect in that region and produce shaping of the workpiece at that location. A corresponding procedure also applies for further regions which are to be shaped.

It will be noted in this respect that the term tubular in the present context denotes a tube of any cross-section, for example round, elliptical, square or rectangular. The tube may also be of varying cross-sections and it may also be of asymmetrical cross-sections. The tube also does not have to be straight but it can be curved and also crooked and skewed.

Preferably the apparatus includes a pressure cylinder which can be fitted to the pressing mold by force-locking or positive-locking engagement therewith and which presses the pressure medium into the workpiece by way of a passage, to provide for the feed of pressure medium into the workpiece.

In accordance with another preferred feature the pressing mold and/or the pressure cylinder may comprise at least one vibrator which also improves conveying the homogenization of the pressure medium.

Further objects, features and advantages of the present invention will be apparent from the following description of embodiments thereof.

DESCRIPTION OF THE PREFERRED EMBODIMENTS

Figure 1:
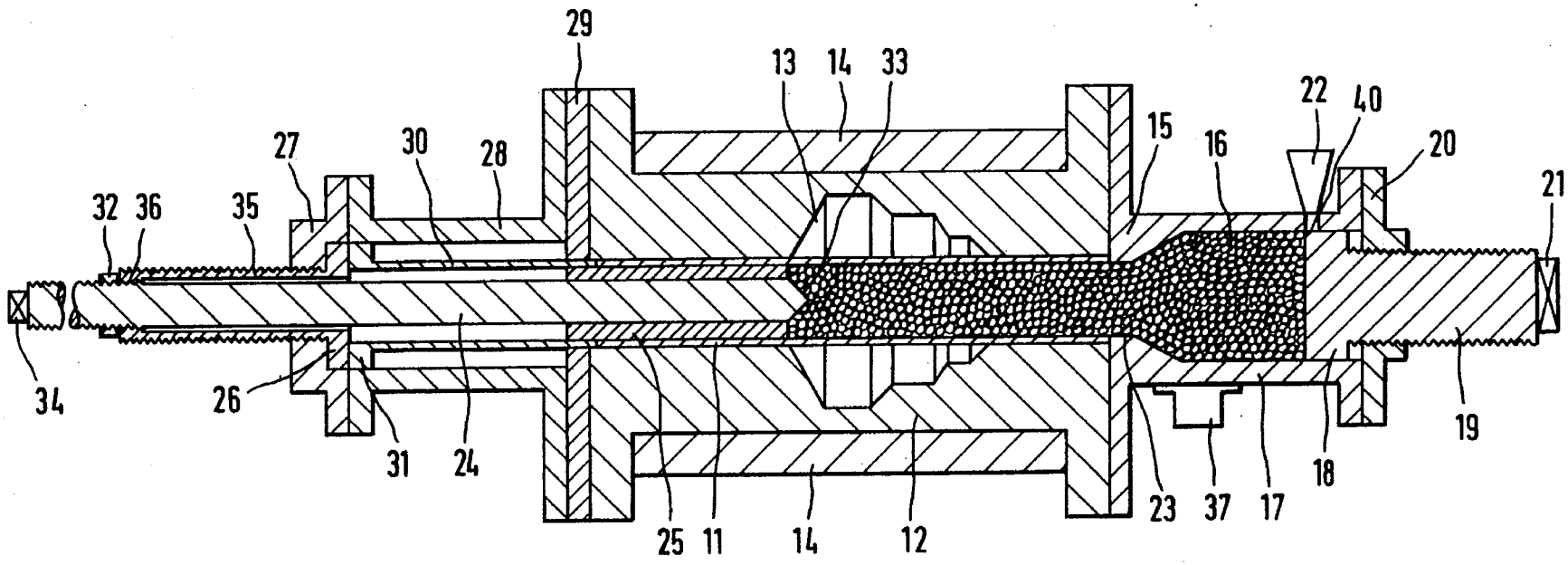
FIG. 1 is a view in cross-section of a workpiece shaping apparatus according to the invention with hollow-section workpiece inserted therein, prior to the beginning of the workpiece shaping operation.

Referring firstly to FIG. 1, a workpiece of metal which is to be subjected to a shaping deformation operation and which in the illustrated situation is an aluminium tube 11 of round cross-section is disposed in a divided pressing mold 12 providing a cavity 13, the internal contour of which corresponds to the workpiece shape to be produced. Reference numeral 14 identifies heating plates or strips for generating and maintaining a desired pressing mold temperature in order to heat the workpiece 11 or to maintain the temperature of a previously heated workpiece.

On the right-hand side in FIG. 1, a conveyor unit 15 for conveying pressure medium 16 in the form of particles or elements of solid matter, such as metal balls, preferably steel balls, is mounted by a mounting flange arrangement on the pressing mold 12. The conveyor unit 15 includes a cylinder 17 for the pressure medium 16 and a piston 18 whose piston rod 19 is provided with an external screwthread and is screwed into an end plate 20 fixed to the cylinder 17. By rotating the piston rod 19 by means of a square portion 21 at the end thereof, the pressure medium 16 which is introduced into the cylinder 17 by way of a hopper 22 is conveyed into the pressing mold 12 through a bore 23. At the beginning of the workpiece shaping operation the opening cross-section 40 of the hopper 22 is closed by the piston 18 having advanced into a position of masking the opening 40.

At the side of the pressing mold 12 which is on the left in FIG. 1, a bar 24 projects into the workpiece 11 disposed in the pressing mold 12, through a guide element 25 which is arranged in the workpiece 11. At its end which is at the left in FIG. 1, the bar 24 has an external screwthread with which it is screwed into a sleeve 35 having at its left-hand end an internal screwthread 36 co-operating with the external screwthread on the bar 24. At the opposite end of the sleeve 35, that is to say at the end thereof which is towards the right in FIG. 1, the sleeve 35 is screwed into an end plate 27 which is mounted by a flange mounting arrangement on the pressing mold 12 by way of a housing 28 and a guide plate 29. Disposed in the housing 28 is a tubular pressure element 30 which, at its left-hand end in FIG. 1, is guided by a flange 31 in the housing 28 while at its other end it is guided in the plate 29 and bears at its end against the adjacent end of the workpiece 11 in the pressing mold 12.

Starting from the position illustrated in FIG. 1 in respect of all the components of the apparatus, shaping deformation of the workpiece 11 begins after the pressing mold 12 with the workpiece 11 is heated to the desired temperature. By means of the square portion 34 at the left-hand end of the bar 24, the bar 24 is displaced towards the workpiece 11, that is to say towards the right in FIG. 1, while at the same time the sleeve 35 is rotated by means of a square portion 32 at the left-hand end thereof in order thereby to displace the pressure element 30 towards the tubular workpiece 11, by way of a flange 26 of the sleeve 35, which bears against the flange 31 of the pressure element 30. The bar 24 then penetrates into the working medium 16 which, as indicated above and as illustrated, can be in the form of steel balls 16. For that purpose, the bar 24 is provided with a cone portion 33 at its tip. When that happens, the workpiece 11 is expanded towards the position shown in FIG. 2 by the pressure applied against the inside surface of the workpiece 11 by the pressure medium balls 16. At the same time as the workpiece 11 is expanded by the balls 16, the workpiece 11 is axially upset by way of the sleeve 35 and the pressure element 30 so that any reduction in the wall thickness of the workpiece, and thus a reduction in the strength thereof, as the workpiece 11 expands, is at least reduced. Displacement of the bar 24 on the one hand and the pressure element 30 on the other hand can be controlled independently of each other, for the purposes of adaptation of the generation of pressure in the pressure medium 16 and the upsetting movement of the workpiece 11.

Figure 2:
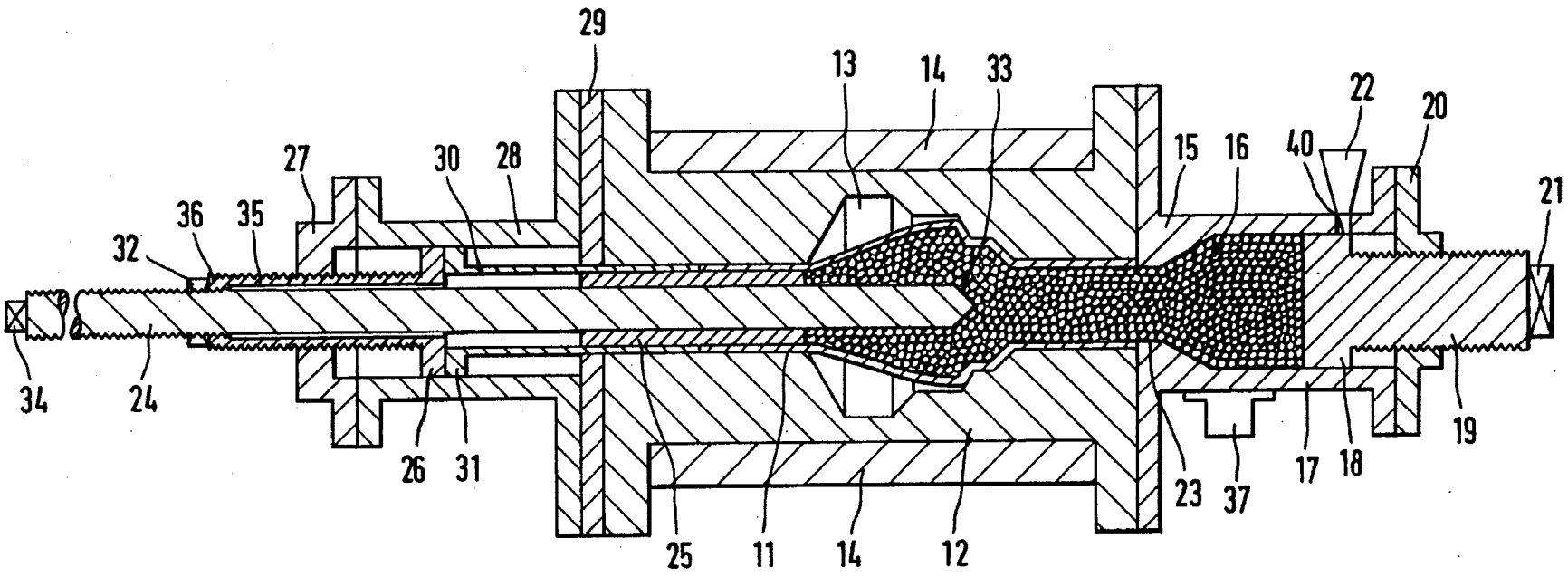
FIG. 2 is a sectional view corresponding to that shown in FIG. 1 after partial shaping of the workpiece.

At the end of the first workpiece shaping step or a plurality of such steps, and associated intermediate steps, in each of which the bar 24 is withdrawn and then into the resulting cavity further steel balls 16 are conveyed by an advance movement of the piston 18 in the cylinder 17, in which case any jamming together of the steel balls 16 is released by means of a vibrator 37 mounted on the conveyor unit 15 for jolting and shaking the steel balls 16, the workpiece 11 has achieved the condition of partial shaping shown in FIG. 2 and all the components of the apparatus are in the position illustrated in FIG. 2. Finally, after further shaping steps with the corresponding intermediate steps as indicated above, the workpiece 11 reaches the shaped configuration shown in FIG. 3. The workpiece 11 can then be removed after opening of the pressing mold 12, and after the pressure medium 16 in the form of the steel balls has been removed or returned into the cylinder 17. Likewise the bar 24 together with the pressure element 30 are also moved back into the initial starting position shown in FIG. 1.

Figure 3:
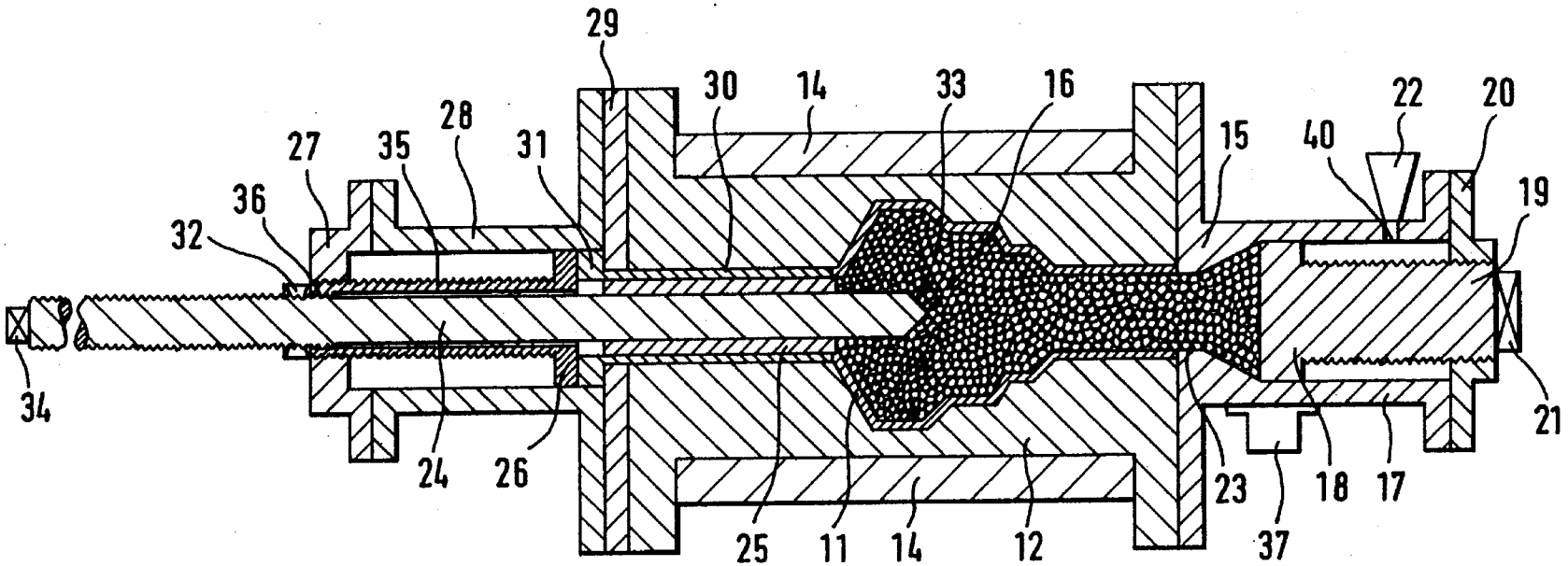
FIG. 3 is a sectional view corresponding to that shown in FIG. 1 after complete shaping of the workpiece.
Figure 4:
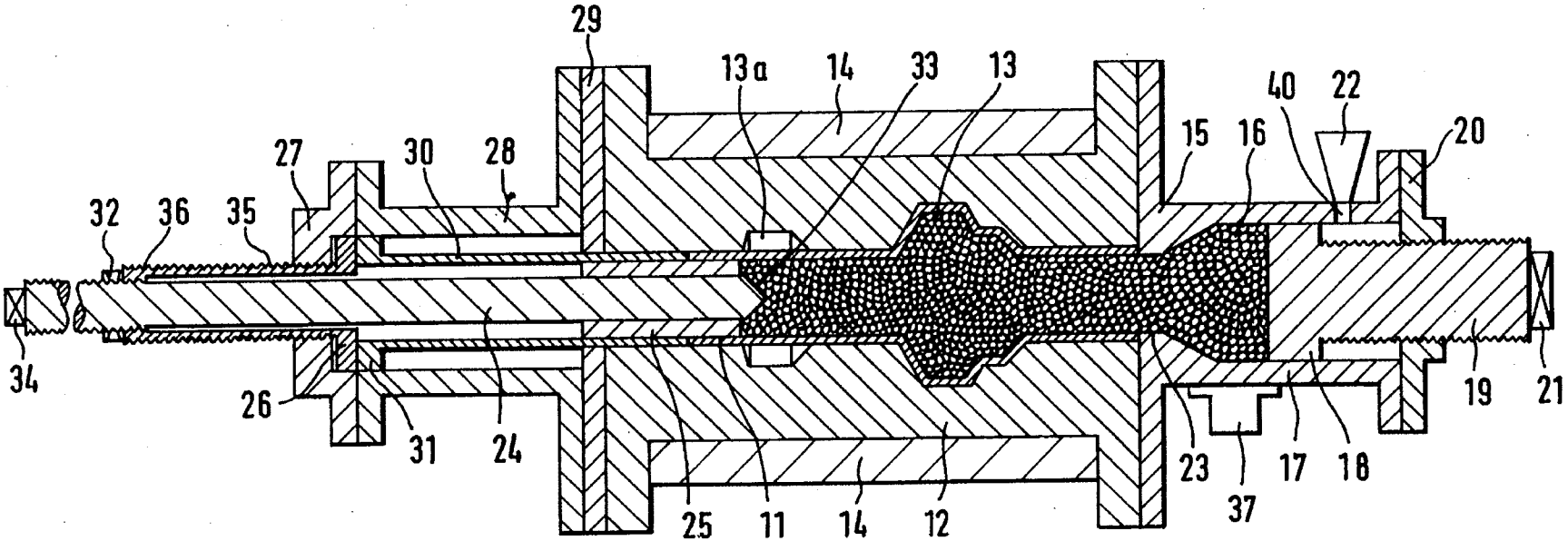
FIG. 4 is a sectional view of a modified embodiment of the workpiece shaping apparatus according to the invention with two workpiece shaping regions, after shaping deformation of the workpiece in a first region and prior to shaping deformation in a second region.
Figure 5:
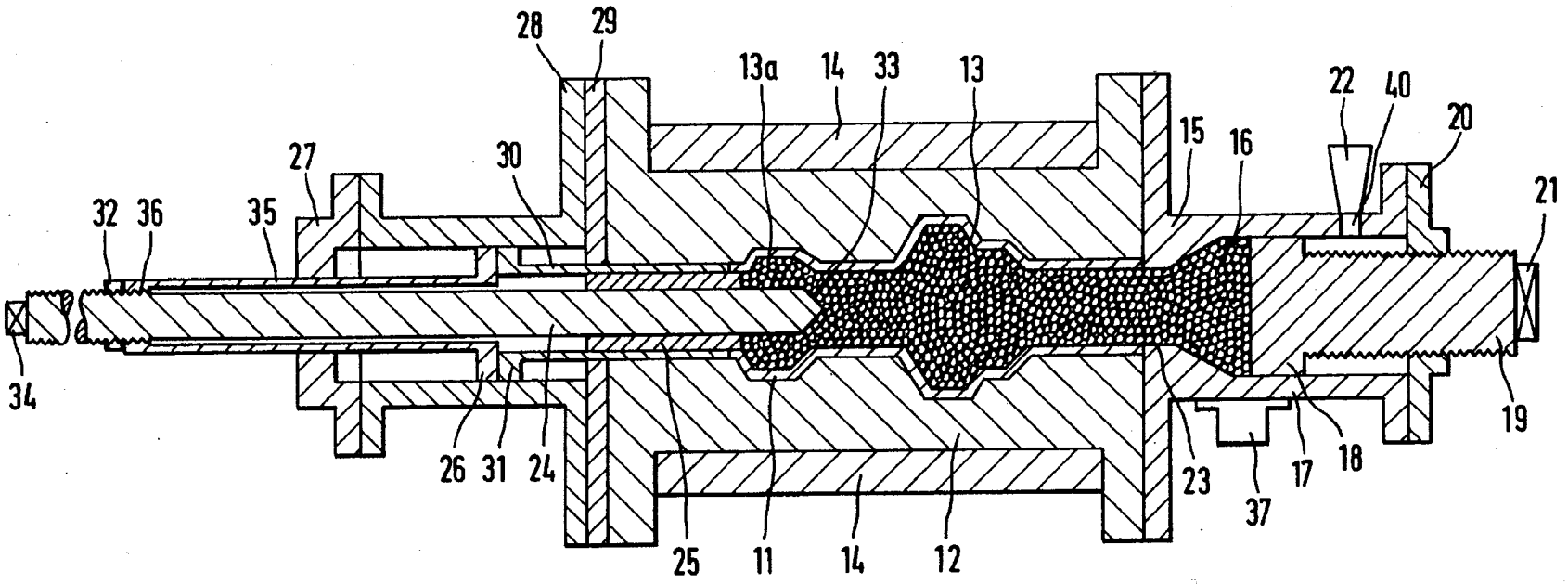
FIG. 5 is a sectional view corresponding to that shown in FIG. 4, after complete shaping of the workpiece.

Reference will now be made to FIGS. 4 and 5 showing a modified embodiment of the apparatus for shaping hollow-section workpieces as shown in FIGS. 1 through 3. The difference in the embodiment of FIGS. 4 and 5 is that in this case, in addition to the cavity 13 which for the sake of simplicity and clarity of the drawing only has two steps here, the pressing mold 12 further provides another cavity **13*a* which in this embodiment is smaller than the first cavity 13 and which forms a further workpiece shaping deformation region. The workpiece 11 can therefore be shaped at two axially successive locations which correspond to the respective cavities 13 and 13*a* of the pressing mold 12**.

Shaping of the workpiece 11 in the region of the cavity 13 is effected in the same manner as in the embodiment of the apparatus shown in FIGS. 1 through 3. In that phase of operation, the guide element 25 which is axially displaceable in the embodiment shown in FIGS. 4 and 5, although the drive for producing such displacement is not shown in FIGS. 4 and 5, is in a position corresponding to that shown in FIGS. 1 through 3 in which therefore its front end face is disposed at the end of the cavity 13, as viewing in the direction of the workpiece shaping steps. For shaping of the workpiece 11 in the region of the further cavity **13*a*, the guide element 25 is then retracted into the position shown in FIG. 4 in which it is now therefore disposed at the end of the cavity 13*a*. Then, in the condition shown in FIG. 4, the pressure medium 16 in the form of for example steel balls is advanced further into the partially shaped workpiece 11, by an advance movement of the piston 18 in the cylinder 17, so that the pressure medium 16 then fills the entire hollow space within the workpiece 11. Shaping of the workpiece then takes place in the region of the cavity 13*a* by virtue of the bar 24 being pressed further into the workpiece 11, that is to say towards the right in FIG. 4, more specifically preferably in a plurality of steps as in the embodiment shown in FIGS. 1 through 3**.

FIG. 5 shows the condition occurring after complete shaping of the workpiece 11 in the region of both cavities 13 and **13*a***.

The apparatuses shown in FIGS. 1 through 5 may be arranged horizontally, as illustrated, but it will be appreciated that it is also possible to adopt a vertical arrangement in such a way that the pressure medium 16, for example in the form of balls, after withdrawal of the bar 24 and suitable shaking or jolting of the balls, drop into the resulting cavity within the workpiece under the influence of the force of gravity. The piston 18 of the pressure cylinder 17 then only has to be advanced within the cylinder 17, for the respective following workpiece shaping step, in order to ensure that the balls 16 are not pushed back into the cylinder 17 again in the next operating step.

It will be seen that the fact that the workpiece shaping pressure is produced at least in part by means of the bar 24 provides that it is possible to produce high and accurately controllable pressures without involving sealing problems. It will be further appreciated that the apparatuses for carrying out the method according to the invention can be suitably designed in accordance with the respective operating conditions and requirements involved and having regard to the respective hollow-section workpieces and metal materials employed. It will be further noted that the apparatus is made of simple components which can be readily fitted together, for example the pressure cylinder unit 17, 18 which provides for the feed of pressure medium 16 into the workpiece can be fitted to the pressing mold 12 by a simple connection involving for example force-locking or positive-locking engagement.

It will be appreciated that the above-described embodiments of the method and apparatus according to the present invention have been set forth solely by way of example and illustration of the principles thereof and that various modifications and alterations may be made therein without thereby departing from the spirit and scope of the invention.

What is claimed is:

1. A method of shaping a hollow-section workpiece of metal, comprising the steps of:

introducing said workpiece into a pressing mold having an internal contour which corresponds to a workpiece shape to be produced;

pressing a pressure medium comprising solid matter into the workpiece while the pressing mold is closed to cause shaping of the workpiece by applying said workpiece to said internal contour of said pressing mold;

wherein said pressing step further includes penetrating said pressure medium with a bar means;

axially up-setting said workpiece within said pressing mold by an axial advancing means.

2. The method as set forth in claim 1, wherein said solid matter comprises metal balls.

3. The method as set forth in claim 2, wherein said balls are comprised of steel.

4. The method as set forth in claim 3, wherein the pressure medium comprises steel balls having a radius of less than approximately 5 mm.

5. The method as set forth in claim 3, wherein the pressure medium comprises steel balls having a radius of less than approximately 2 mm.

6. The method as set forth in claim 1, wherein said pressing step further comprises the steps of advancing and withdrawing said bar means within said mold and the step of advancing said pressure medium within said mold after a respective withdrawing of said bar means.

7. The method as set forth in claim 6, wherein said step of advancing said pressure medium further includes using a pressure cylinder means.

8. The method as set forth in claim 6, wherein said step of advancing said pressure medium further includes using the force of gravity.

9. The method as set forth in claim 6, further including the step of jostling said pressure medium during said step of withdrawing said bar means.

10. The method as set forth in claim 6, further including the step of jostling said pressure medium after said step of withdrawing said bar means.

11. The method as set forth in claim 6, further including the step of jostling said pressure medium during said step of advancing said bar means.

12. The method as set forth in claim 1, wherein said workpiece is heated to a temperature of at least approximately 200° C.

13. The method as set forth in claim 1, wherein said pressure medium comprises silicon oxide grains.

14. The method as set forth in claim 1, wherein said pressure medium comprises silicon oxide balls.

15. The method as set forth in claim 1, wherein said pressure medium comprises a mixture of at least two kinds of solid matter.

16. The method as set forth in claim 1, wherein said pressure medium comprises a mixture of at least two kinds of solid matter, having different sizes respectively.

17. The method as set forth in claim 1, further comprising the step of partially heating said workpiece with said pressing mold prior to said pressing step.

18. The method as set forth in claim 17, further comprising the step of preheating said workpiece prior to said step of introducing said workpiece into said pressing mold.

19. The method as set forth in claim 17, further comprising the step of preheating said pressure medium prior to said step of pressing said pressure medium.

20. The method as set forth in claim 1, wherein said step of axially upsetting said workpiece is controlled independently of said pressing of said pressure medium.

21. A device for shaping a hollow-section workpiece of metal, comprising:

a pressing mold having an internal contour which corresponds to a workpiece shape to be produced;

a pressure medium comprising solid matter disposed within said pressing mold;

a pressing means being adapted to be used while said pressing mold is closed to press said pressure medium into said pressing mold so that said workpiece is shaped by being applied against the internal contour of the pressing mold;

said pressing means further comprising a bar means and means for pressing said bar means into said pressure medium for generating pressure therein; and means for axially advancing said workpiece within said pressure mold.

22. The device as set forth in claim 21, wherein said bar means further includes a cone portion.

23. The device as set forth in claim 21, for shaping a tubular workpiece having an interior surface, comprising:

a guide tube adapted to bear against said interior surface of said tubular workpiece having an internal axial bore therein for slidingly accommodating said bar means; and means for axially displacing said guide tube within said workpiece.

24. The device as set forth in claim 21, further including a pressure cylinder for supplying said pressure medium into said workpiece; and means for mounting said pressure cylinder to said pressing mold.

25. The device as set forth in claim 24, wherein said pressing mold further includes at least one vibrator.

26. The device as set forth in claim 24, wherein said pressure cylinder further includes at least one vibrator.

27. The device as set forth in claim 24, wherein said pressure cylinder is force-lockingly engaged to said mounting means.

28. The device as set forth in claim 24, wherein said pressure cylinder is positively lockingly engaged to said mounting means.

29. A method of shaping hollow-section workpieces of metal comprising the steps of:

introducing a workpiece to be shaped into a pressing mold having at least one cavity having an internal contour which corresponds to a workpiece shape to be produced;

introducing a pressure medium including solid particulate material into said hollow-section workpiece;

penetrating said pressure medium within said workpiece to create a pressure within said pressure medium at a first location relative to said workpiece, and applying a second pressure to said pressure medium at a second location relative to said workpiece, space-away from said first location whereby said pressures shape said workpiece by applying said workpiece to the internal contour of the cavity of the pressing mold.

* * * * *

UNITED STATES PATENT AND TRADEMARK OFFICE

CERTIFICATE OF CORRECTION

PATENT NO. : 5,505,068

DATED : April 9, 1996

INVENTOR(S) : Hermann Bartels

It is certified that error appears in the above-indentified patent and that said Letters Patent is hereby corrected as shown below:

Column 1, line 28, "Industries-Anzeiger", should be --Industrie-Anzeiger--.

Column 1, line 52, "hollow-shaping" should be --hollow-section--.

Column 2, line 31, after "provide" insert --that--.

Column 4, line 10, "and", second occurrence, should be --or--.

Column 4, line 19, "the" should be --and--.

Column 10, line 1, "space-away" should be --spaced-away--.

Signed and Sealed this

Tenth Day of September, 1996

*Attest:*

*Attesting Officer*

BRUCE LEHMAN

*Commissioner of Patents and Trademarks*